US011181310B2

(12) United States Patent
Harata et al.

(10) Patent No.: US 11,181,310 B2
(45) Date of Patent: Nov. 23, 2021

(54) ICE MAKER

(71) Applicant: NIDEC SANKYO CORPORATION, Nagano (JP)

(72) Inventors: Takaji Harata, Nagano (JP); Katsuhiko Hayashi, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 63 days.

(21) Appl. No.: 16/576,798

(22) Filed: Sep. 20, 2019

(65) Prior Publication Data

US 2020/0124331 A1 Apr. 23, 2020

(30) Foreign Application Priority Data

Sep. 21, 2018 (JP) ..... JP2018-176782

(51) Int. Cl.
*F25C 1/10* (2006.01)
*F25C 1/24* (2018.01)

(52) U.S. Cl.
CPC ..... *F25C 1/10* (2013.01); *F25C 1/24* (2013.01)

(58) Field of Classification Search
CPC ..... F25C 1/10; F25C 1/24; F25C 1/04; F25C 2500/06; F25C 2305/022; F25C 1/25
USPC ..... 62/66, 138, 139, 340
See application file for complete search history.

(56) References Cited

U.S. PATENT DOCUMENTS 1,793,446 A * 2/1931 Stone ..... E03D 1/302 4/362
3,252,293 A * 5/1966 Frei, Sr. ..... F25C 1/24 62/135
3,563,050 A * 2/1971 Fox ..... F25C 1/04 62/233
4,265,089 A * 5/1981 Webb ..... F25C 1/04 280/801.2
8,820,108 B2 * 9/2014 Oh ..... F25C 5/06 62/340

(Continued)

FOREIGN PATENT DOCUMENTS

CN 102455094 5/2012
CN 102878744 1/2013

(Continued)

OTHER PUBLICATIONS

Office Action of China Counterpart Application, with English translation thereof, dated Jan. 29, 2021, pp. 1-14.

*Primary Examiner* — Eric S Ruppert
*Assistant Examiner* — Kirstin U Oswald
(74) *Attorney, Agent, or Firm* — JCIPRNET

(57) ABSTRACT

In an ice maker, water from a water supply pipe passes through a water flow port provided in a frame and is poured into a water receiving unit protruding outward from an ice making tray 5. The frame includes a first water channel portion intersecting a direction of an axis and the water flow port is provided in a side surface of the first water channel portion on a side of the ice making tray. Further, the frame includes a convex unit functioning as a water blocking unit and provided in a position on the upstream side of the water flow port and along the side surface in which the water flow port is provided. As a result, it is possible to prevent or suppress water flowing in a direction different from the opening direction of the water flow port, from reaching the water flow port.

12 Claims, 10 Drawing Sheets

(56) References Cited

U.S. PATENT DOCUMENTS

| | | | | |
|---|---|---|---|---|
| 9,074,804 | B2 | 7/2015 | Yoon | |
| 9,234,689 | B2 | 1/2016 | Son et al. | |
| 9,335,081 | B2 | 5/2016 | Son et al. | |
| 2013/0291583 | A1* | 11/2013 | Bauman | F25C 1/24 62/340 |
| 2015/0241102 | A1* | 8/2015 | Lee | F25C 1/10 62/71 |

FOREIGN PATENT DOCUMENTS

| | | | |
|---|---|---|---|
| CN | 103033011 | | 4/2013 |
| CN | 103185447 | | 7/2013 |
| JP | 08258895 | A * | 10/1996 |
| JP | 2003106717 | | 4/2003 |
| JP | 2006258311 | | 9/2006 |
| JP | 2012207824 | | 10/2012 |

* cited by examiner

ICE MAKER

CROSS REFERENCE TO RELATED APPLICATION

The present application claims priority under 35 U.S.C. § 119 to Japanese Application No. 2018-176782 filed Sep. 21, 2018, and the entire content of which is incorporated herein by reference.

BACKGROUND

Field of the Invention

At least an embodiment of the present invention relates to an ice maker for storing water supplied from a water supply pipe in an ice making tray to make ice.

Description of the Related Documents

An ice maker installed in a refrigerator is described in Japanese Unexamined Patent Application Publication No. 2012-207824 (hereinafter, referred to as Patent Literature 1). The ice maker described in Patent Literature 1 includes: an ice making tray including water storage concave units; a driving unit configured to flip the ice making tray around an axis passing through the ice making tray; and a frame configured to support the ice making tray and the driving unit. In the ice maker, water supplied from a water supply pipe is filled into water storage concave units to make ice. Further, when the ice making is completed, the ice maker uses the driving unit to flip the ice making tray and causes a portion of the ice making tray to abut against the frame to twist the ice making tray. As a result, the ice is removed from the ice making tray and dropped into an ice storage container arranged below the ice making tray. In Patent Literature 1, a water supply port of the water supply pipe is located above the ice making tray and the water is directly poured into the ice making tray.

To prevent interference between an ice making tray and a water supply pipe when the ice making tray is flipped (rotated) to remove ice from the ice making tray, an ice maker has been proposed which supplies water to the ice making tray via a water channel provided in a frame supporting the ice making tray, without supplying the water of the water supply pipe directly to the ice making tray. This type of ice maker has a configuration in which the frame is provided with a water flow port communicating with the water channel, and the water flowing through the water channel is poured from the water flow port into a water receiving unit of the ice making tray. However, if the water flow port opens toward a direction intersecting the direction from an upstream side to a downstream side of the water channel, there is a problem in that water scatters from the water flow port not only downward of the water flow port but also outward of the water receiving unit.

In view of the problems described above, an object of at least an embodiment of the present invention is to suppress water supplied to the ice making tray from the water channel provided in the frame, from spilling out of the ice making tray.

SUMMARY

To solve the problems described above, an ice maker according to at least an embodiment of the present invention is characterized in that the ice maker includes: an ice making tray including a water storage concave unit configured to store water supplied from a water supply pipe; a driving unit configured to make the ice making tray rotate around an axis passing through the ice making tray, so as to flip between a water storage position where the water storage concave unit faces upward and an ice removal position where the water storage concave unit faces downward; and a frame configured to support the ice making tray and the driving unit. The ice making tray includes a water receiving unit protruding outward from a portion of the ice making tray that moves downward when the ice making tray starts to rotate in a first rotation direction from the water storage position toward the ice removal position, the water receiving unit communicates with the water storage concave unit, the frame includes a frame portion located above the water receiving unit, the frame portion includes: a water channel extending in a direction intersecting the axis at an upper surface of the frame portion; a water flow port, wherein at least a part of the water flow port is provided on a side surface of the water channel; and a water blocking unit provided at a position on an upstream side of the water channel with respect to the water flow port and along the side surface, the water flow port is disposed at a position overlapping with the water receiving unit to cause the water to flow when the ice making tray in the water storage position is viewed from an up-down direction, and the water from the water supply pipe is poured into the water receiving unit through the water flow port, and flows into the water storage concave unit.

In at least an embodiment of the present invention, water from the water supply pipe is poured into the water channel provided in the frame, passes through the water flow port provided on the side surface of the water channel, is poured into the water receiving unit protruding outward from the ice making tray, and flows into the water storage concave unit. Therefore, a water supply port of the water supply pipe can be located outside the ice making tray, and interference between the ice making tray and the water supply pipe can be prevented. Further, the water flow port is provided on the side surface of the water channel, and a water blocking unit is provided in the frame at a position on the upstream side of the water flow port and along the side surface on which the water flow port is provided. In this way, on the upstream side of the water flow port, the direction of the flow in the direction (direction along the side surface) intersecting the opening direction of the water flow port can be changed by the water blocking unit. As a result, it is possible to reduce the flow amount of water flowing from the water flow port in a direction different from the opening direction of the water flow port, and thus, the water is not likely to spill out of the water receiving unit provided below the water flow port.

In at least an embodiment of the present invention, it is preferable that the water blocking unit is a convex unit protruding from the side surface toward the inside of the water channel. In this way, if the water blocking unit is formed integrally with the side surface of the water channel, the structure of the water blocking unit can be simplified. Further, when the water blocking unit is formed integrally with the side surface of the water channel, the flow toward the water flow port along the side surface can be effectively blocked.

In at least an embodiment of the present invention, it is preferable that the convex unit is provided at an opening edge of the water flow port. In this way, it is possible to block, immediately before the water flow port, the flow in a direction (direction along the side surface) intersecting with the opening direction of the water flow port. Therefore, the flow amount of water flowing from the water flow port in a direction different from the opening direction of the water flow port can be effectively reduced.

In at least an embodiment of the present invention, it is preferable that the convex unit includes: a first surface facing a side where the water flow port is located; and a second surface facing a side opposite to the side where the water flow port is located, wherein the first surface is connected to the opening edge of the water flow port and is substantially perpendicular to the side surface, and the second surface is an inclined surface that forms an obtuse angle with the side surface. In this way, when the second surface is an inclined surface, the water can be prevented from splashing due to the flow from the upstream side colliding with the second surface, and the water can be prevented or suppressed from spilling from the water channel. Further, it is possible to prevent or suppress water from remaining between the side surface and the second surface and freezing. Moreover, the water can be guided by the first surface to flow in the opening direction of the water flow port immediately before the water flow port. Therefore, the flow amount of water flowing from the water flow port in a direction different from the opening direction of the water flow port can be reduced.

In at least an embodiment of the present invention, it is preferable that the water channel includes a buffer region extending to the opposite side of the water blocking unit with respect to the water flow port. In this way, it is possible to suppress the occurrence of water splash on the opposite side of the water blocking unit with respect to the water flow port, and the water can be prevented or suppressed from spilling from the water channel.

In at least an embodiment of the present invention, it is preferable that a bottom surface of the water channel includes an inclined surface descending toward the water flow port. In this way, the water in the water channel can be collected toward the water flow port. Therefore, it is possible to prevent or suppress water from remaining in the water channel and freezing.

In at least an embodiment of the present invention, it is preferable that the frame portion includes a guide plate protruding from the opening edge of the water flow port to the outside of the water channel. In this way, the water passing through the water flow port can be guided to not spread in a direction different from the opening direction of the water flow port. Therefore, the water does not easily spill out of the water receiving unit.

In at least an embodiment of the present invention, it is preferable that the guide plate is located on an opposite side of the water blocking unit with respect to the water flow port. In this way, the guide plate can be provided on a side where water easily flows from the water flow port in a direction different from the opening direction of the water flow port. Therefore, the water does not easily spill out of the water receiving unit.

In at least an embodiment of the present invention, it is preferable that the guide plate includes: a first guide plate located on the opposite side of the water blocking unit with respect to the water flow port; and a second guide plate located on the same side as the water blocking unit with respect to the water flow port. A protruding dimension of the first guide plate protruding from the opening edge is larger than a protruding dimension of the second guide plate protruding from the opening edge. In this way, the water passing through the water flow port can be guided on both sides of the water flow port. Therefore, the water does not easily spill out of the water receiving unit. Further, when the protruding dimension of the guide plate (first guide plate) on the side where water easily flows in the direction different from the opening direction of the water flow port is increased, it is possible to effectively suppress water from spilling out of the water receiving unit. Further, when the protruding dimension of the other guide plate (second guide plate) is reduced, an interference between the guide plate and the ice making tray can be avoided.

In at least an embodiment of the present invention, it is preferable that the water flow port includes: a first water flow port portion provided on a bottom surface of the water channel; and a second water flow port portion provided on the side surface and connected to the first water flow port portion, wherein the guide plate extends in an up-down direction along an opening edge of the second water flow port portion and is connected to a guiding board protruding downward from an opening edge of the first water flow port portion, the guiding board configured to guide the water passing through the water flow port into the water receiving unit. In this way, the water passing through the water flow port can be guided below the water flow port, and thus, it is possible to suppress water from spilling out of the water receiving unit.

In at least an embodiment of the present invention, it is desirable that the ice making tray includes: a peripheral wall unit surrounding an opening of the water storage concave unit and extending upward when the ice making tray is arranged in the water storage position; and a notch unit provided in a part of the peripheral wall unit in a circumferential direction, wherein the water receiving unit includes: a bottom unit protruding outward from an edge portion on a lower side of the notch unit in the peripheral wall unit and facing the frame portion when the ice making tray is arranged in the water storage position; a pair of side plate units with lower ends connected to the bottom unit wherein the pair of side plate units protrude outward respectively from an edge portion on one side and an edge portion on the other side of the notch unit in the circumferential direction of the peripheral wall unit; and an end plate unit connecting a tip end portion of the bottom unit and tip end portions of the pair of side plate units, wherein a lower end of the guiding board is located lower than an upper end of the pair of side plate units when the ice making tray is arranged in the water storage position. In this way, it is possible to prevent or suppress the water poured into the water receiving unit after passing through the water flow port, from scattering out from the water receiving unit.

In at least an embodiment of the present invention, it is desirable that the driving unit is coupled to one side of the ice making tray in a direction of the axis, and the water receiving unit protrudes outward from a portion near the other side of the ice making tray in the direction of the axis. In this way, even if the water poured into the water receiving unit is scattered, it is possible to present or suppress water from reaching the driving unit.

In at least an embodiment of the present invention, it is desirable that the ice making tray is made of a flexible material, and the frame includes an abutment unit abutting the water receiving unit from a front side in the first rotation direction when the ice making tray rotates in the first rotation direction and reaches the ice removal position, so as to block a rotation of the ice making tray that is driven in the first rotation direction. In this way, when the water receiving unit and the abutment unit abut against each other and the rotation of the ice making tray is blocked, the ice making tray is twisted. Therefore, the ice is easily removed from the ice making tray when the ice making tray reaches the ice removal position.

According to at least an embodiment of the present invention, the water from the water supply pipe is poured into the water channel provided in the frame, passes through the water flow port provided on the side surface of the water channel, is poured into the water receiving unit protruding outward from the ice making tray, and flows from the water receiving unit into the water storage concave unit. Therefore, the water supply port of the water supply pipe can be located outside the ice making tray, and the water supply pipe can be prevented from interfering with the ice making tray. Further, the water flow port is provided on the side surface of the water channel, and the water blocking unit is provided in the frame at a position on the upstream side of the water flow port and along the side surface on which the water flow port is provided. In this way, on the upstream side of the water flow port, the direction of the flow in the direction (direction along the side surface) intersecting the opening direction of the water flow port can be changed by the water blocking unit. As a result, it is possible to reduce the flow amount of water flowing from the water flow port in a direction different from the opening direction of the water flow port, and thus, the water is not likely to spill out of the water receiving unit provided below the water flow port.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Below, an ice maker according to at least an embodiment of the present invention will be described with reference to the drawings.

(Overall Configuration)

Figure 1:
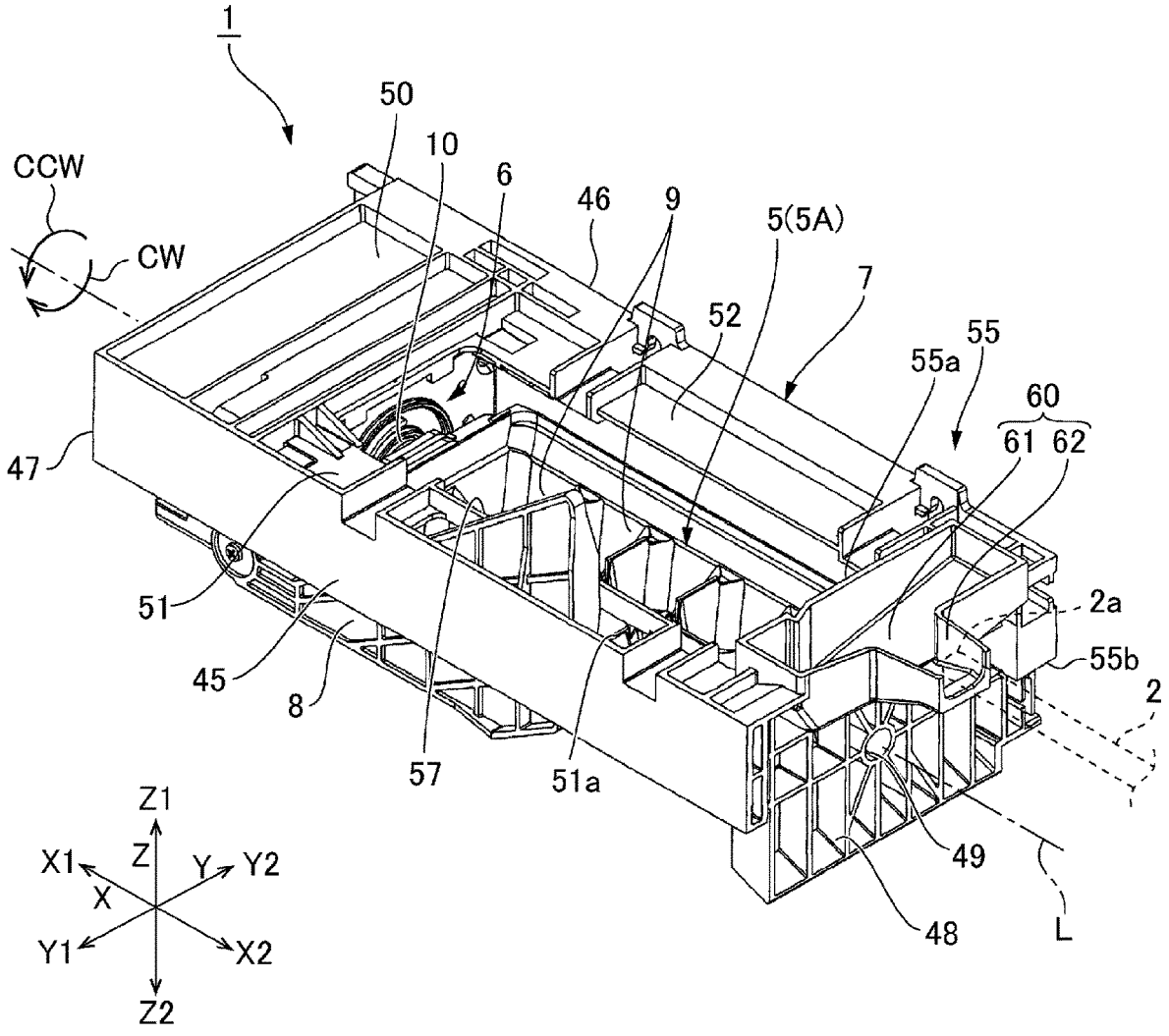
FIG. 1 is a perspective view of an ice maker to which at least an embodiment of the present invention is applied when viewed from above.
Figure 2:
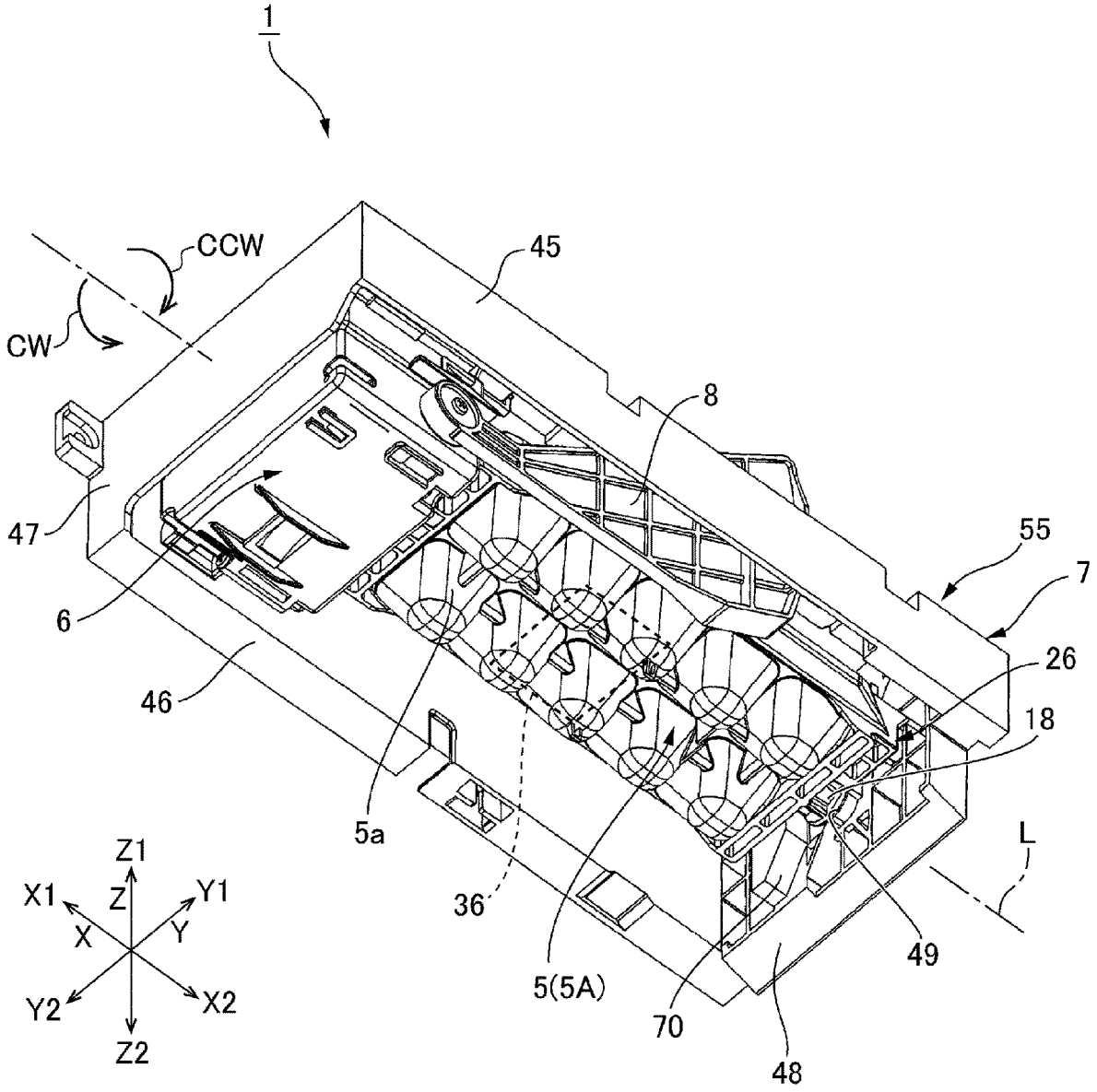
FIG. 2 is a perspective view of the ice maker with an ice making tray in a water storage position when viewed from below.
Figure 3:
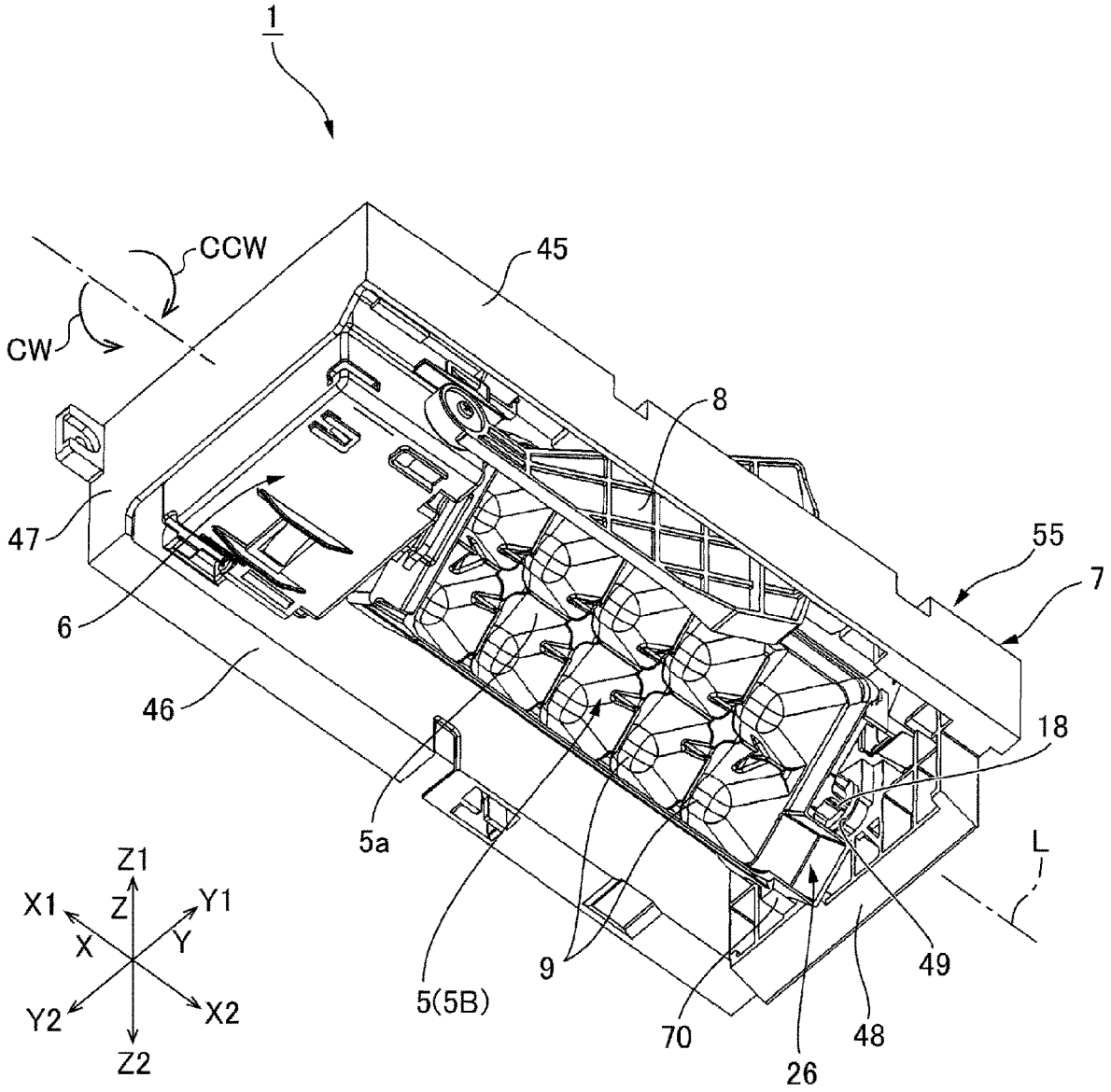
FIG. 3 is a perspective view of the ice maker with the ice making tray in an ice removal position when viewed from below.
Figure 4:
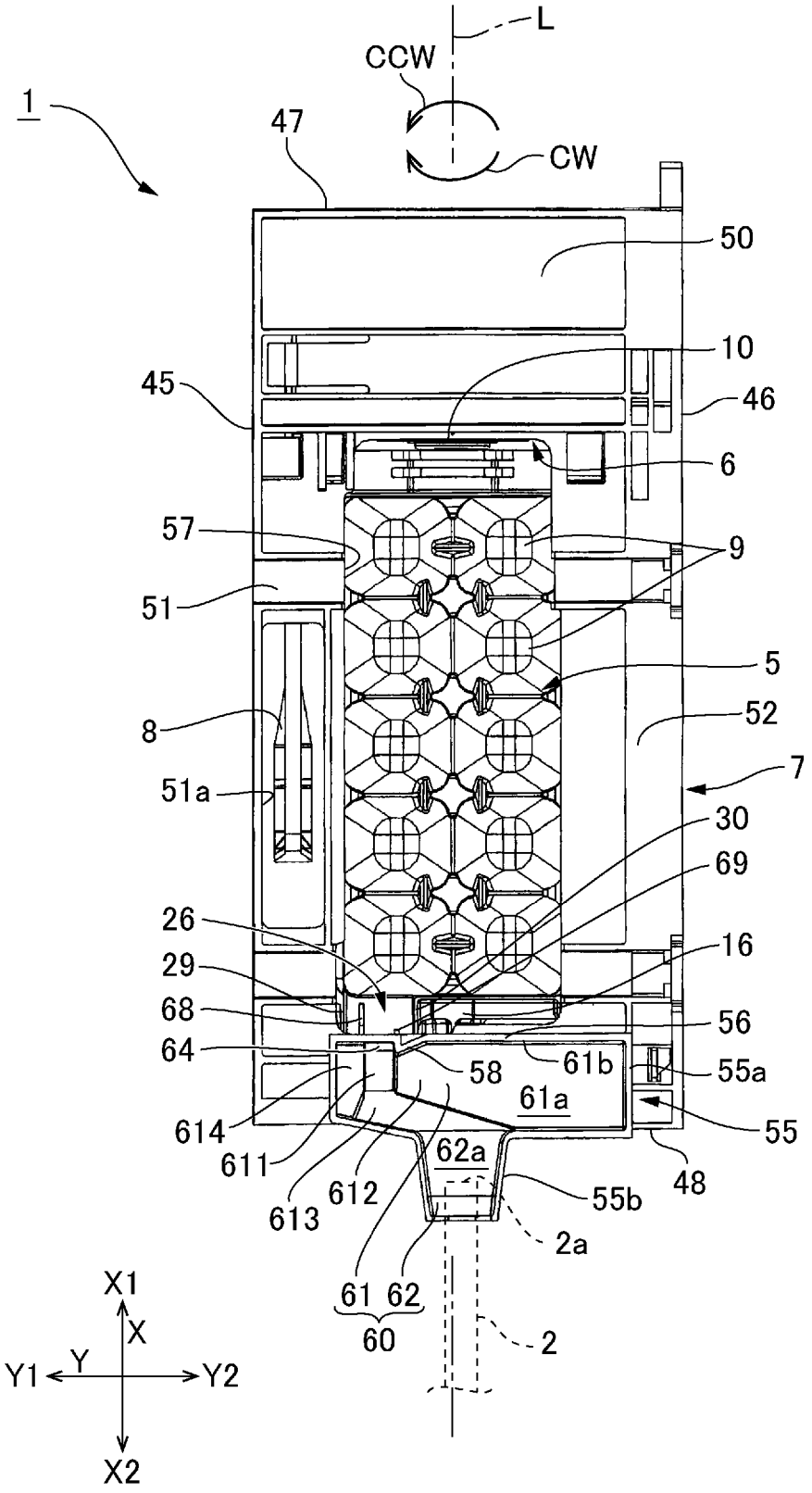
FIG. 4 is a plan view of the ice maker.
Figure 5:
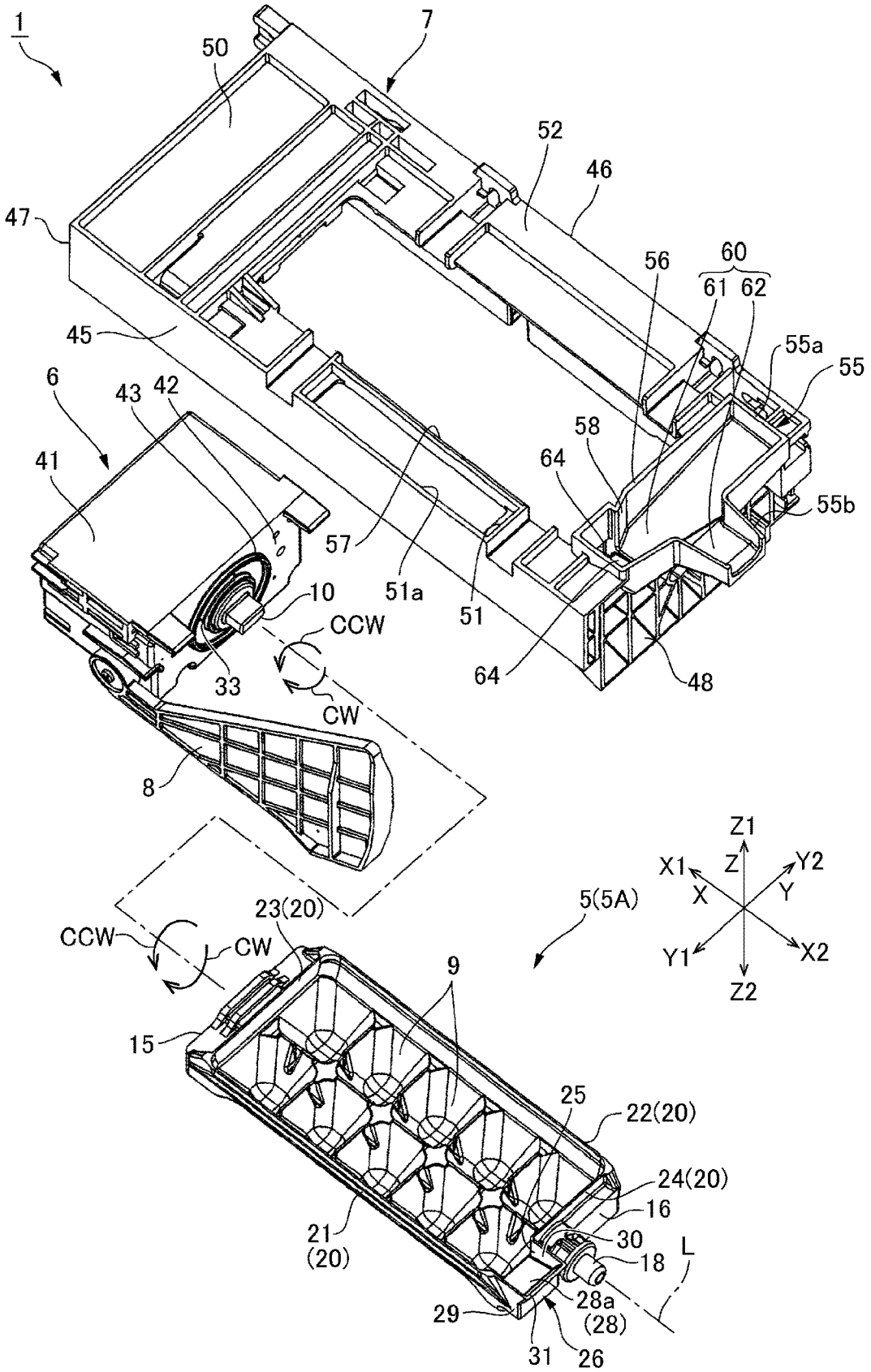
FIG. 5 is an exploded perspective view of the ice maker.

FIG. 1 is a perspective view of the ice maker to which at least an embodiment of the present invention is applied when viewed from above. FIG. 2 is a perspective view of the ice maker of FIG. 1 when viewed from below. In FIGS. 1 and 2, an ice making tray of the ice maker is in a water storage position. FIG. 3 is a perspective view in which the ice making tray is in an ice removal position when viewed from below. FIG. 4 is a plan view of the ice maker. FIG. 5 is an exploded perspective view of the ice maker.

An ice maker 1 is installed in a refrigerator. As illustrated in FIG. 1, the ice maker 1 includes an ice making tray 5, a driving unit 6 configured to flip the ice making tray 5, and a frame 7 configured to support the ice making tray 5 and the driving unit 6. A planar shape of the ice making tray 5 is a substantially rectangular shape. The ice making tray 5 includes a plurality of water storage concave units 9 configured to store water supplied from a water supply pipe 2. The driving unit 6 flips the ice making tray 5 around an axis L passing in the longitudinal direction through a center portion in the shorter direction of the ice making tray 5. An output shaft 10 (see FIG. 5) of the driving unit 6 is coupled to an end portion on one side of the ice making tray 5 in the direction of the axis L. Drive of the driving unit 6 rotates the ice making tray 5 from a water storage position 5A where the water storage concave units 9 face upward to an ice removal position 5B where the water storage concave units 9 face downward, and vice versa. In FIGS. 1 and 2, the ice making tray 5 is arranged in the water storage position 5A. In FIG. 3, the ice making tray 5 is arranged in the ice removal position 5B.

As illustrated in FIGS. 1 and 2, the ice maker 1 places the ice making tray 5 in the water storage position 5A and stores water supplied from the water supply pipe 2 in the water storage concave units 9 of the ice making tray 5 to make ice. When the ice making is completed, as illustrated in FIG. 3, the ice maker 1 drives the driving unit 6 to rotate the ice making tray 5 from the water storage position 5A to the ice removal position 5B, and drop the ice of the ice making tray 5 into an ice storage container (not illustrated) placed below the ice maker 1.

In the following description, three directions perpendicular to one another are referred to as an X direction, a Y direction, and a Z direction. The X direction is the direction of the axis L. The Z direction is an up-down direction in the installation posture of the ice maker 1 (the posture illustrated in FIG. 1). The Y direction is a direction perpendicular to the direction of the axis L and the up-down direction. Further, in the X direction, the side on which the driving unit 6 is located is defined as an X1 direction and the side on which the ice making tray 5 is located is defined as an X2 direction. In the Z direction, the upper side is defined as a Z1 direction and the lower side is defined as a Z2 direction. Further, in the Y direction, the direction in which the openings of the water storage concave units 9 face when the ice making tray 5 rotates around the axis L in a CCW direction (first rotation direction) from the water storage position 5A toward the ice removal position 5B is defined as a Y1 direction, and the opposite side thereof is defined as a Y2 direction.

(Ice Making Tray)

Figure 6A:
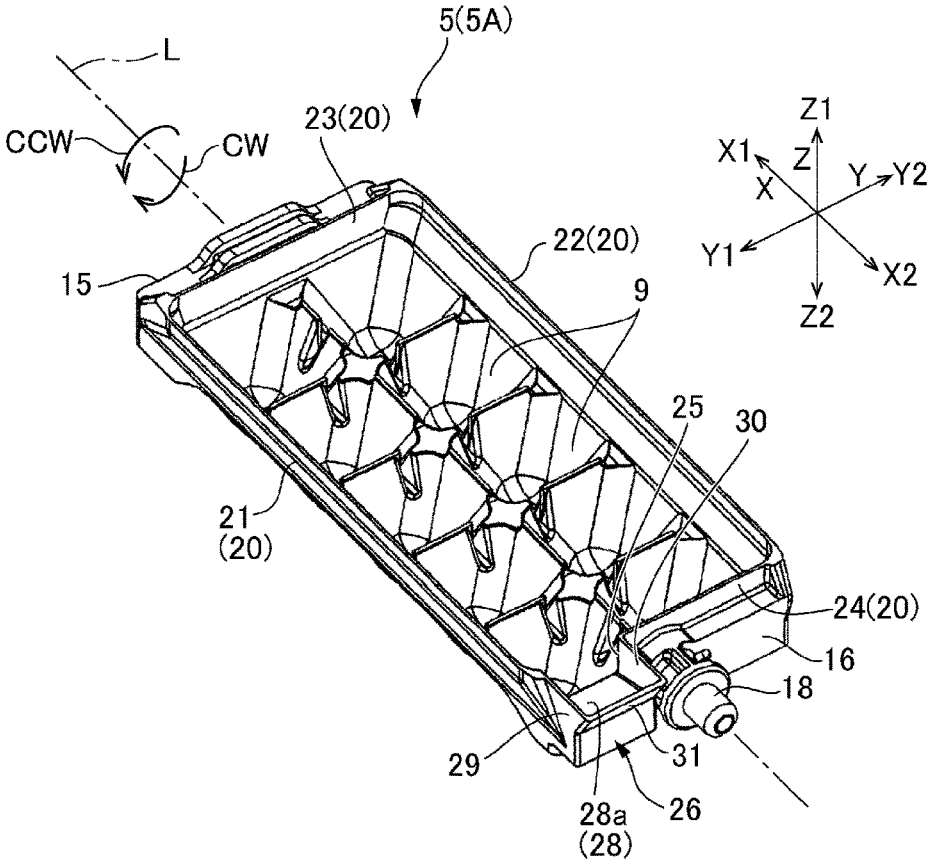
FIGS. 6A and 6B are perspective views of the ice making tray.
Figure 6B:
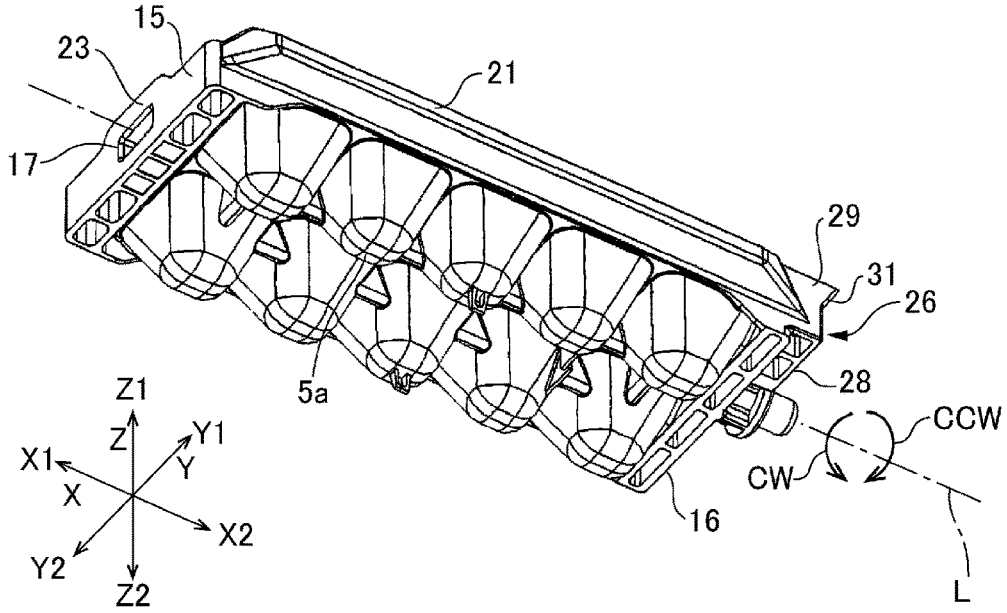

FIG. 6A is a perspective view of the ice making tray 5 when viewed from the Z1 direction and FIG. 6B is a perspective view of the ice making tray 5 when viewed from the Z2 direction. The ice making tray 5 is made of an elastically deformable material. In the present embodiment, the ice making tray 5 is made of a resin material. As illustrated in FIGS. 6A and 6B, the ice making tray 5 includes a first wall unit 15 located in the X1 direction and a second wall unit 16 located in the X2 direction. As illustrated in FIG. 6B, a coupling unit 17 coupled to the output shaft 10 of the driving unit 6 is provided on the first wall unit 15. As illustrated in FIG. 6A, a shaft unit 18 is provided on the second wall unit 16 coaxially with the coupling unit 17. The shaft unit 18 protrudes in the X2 direction from the second wall unit 16. The plurality of water storage concave units 9 are arranged between the first wall unit 15 and the second wall unit 16. The water storage concave units 9 are arranged in five rows in the X direction as pairs of two water storage concave units 9 arranged in the Y direction.

Further, the ice making tray 5 includes a frame-shaped peripheral wall unit 20 extending upward and surrounding the openings of the plurality of water storage concave units 9 when the ice making tray 5 is arranged in the water storage position 5A. The peripheral wall unit 20 includes: a first peripheral wall portion 21 extending in the X direction on the side of the Y1 direction of the plurality of water storage concave units 9; a second peripheral wall portion 22 extending in the X direction on the side of the Y2 direction of the plurality of water storage concave units 9; a third peripheral wall portion 23 extending in the Y direction and connecting end portions of the first peripheral wall portion 21 and the second peripheral wall portion 22 in the X1 direction; and a fourth peripheral wall portion 24 extending in the Y direction and connecting end portions of the first peripheral wall portion 21 and the second peripheral wall portion 22 in the X2 direction. The first peripheral wall portion 21 and the second peripheral wall portion 22 face each other in the Y direction, and the third peripheral wall portion 23 and the fourth peripheral wall portion 24 face each other in the X direction. Further, the fourth peripheral wall portion 24 includes a notch unit 25 on the side further in the Y1 direction relative to the shaft unit 18. The notch unit 25 is rectangular and extends from the upper end edge of the fourth peripheral wall portion 24 toward the Z2 direction (downward).

Further, the ice making tray 5 includes a water receiving unit 26 protruding from the fourth peripheral wall portion 24 in the X2 direction of the X direction (the direction of the axis L). The water receiving unit 26 is located further in the Y1 direction relative to the shaft unit 18. The water receiving unit 26 includes: a bottom unit 28 protruding outward from an edge portion in the Z2 direction (lower edge portion) of the notch unit 25 in the fourth peripheral wall portion 24; a pair of side plate units 29 and 30 with lower ends connected to the bottom unit 28, wherein the pair of side plate units 29 and 30 protrude outward respectively from an edge portion in the Y1 direction and an edge portion in the Y2 direction of the notch unit 25 in the fourth peripheral wall portion 24; and an end plate unit 31 connecting a tip end portion of the bottom unit 28 and tip end portions of the pair of side plate units 29 and 30. The bottom unit 28 includes an upper surface 28*a* inclining downward from the side of the end plate unit 31 toward the side of the peripheral wall unit 20 (the side of the notch unit 25). Further, the end plate unit 31 is inclined to the side of the peripheral wall unit 20 (the side of the notch unit 25) toward the bottom unit 28. Via the notch unit 25, the water receiving unit 26 is in communication with the plurality of water storage concave units 9 located inside the peripheral wall unit 20.

Here, the water receiving unit 26 is provided in a portion of the ice making tray 5 located further in the Y1 direction relative to the shaft unit 18. The portion located further in the Y1 direction relative to the shaft unit 18 is a portion of the ice making tray 5 that moves in the Z2 direction (downward), when the ice making tray 5 starts to rotate in the CCW direction from the water storage position 5A toward the ice removal position 5B.

As illustrated in FIG. 2, in the ice making tray 5, convex units reflecting the shape of the water storage concave units 9 are arranged on a lower surface 5*a* in the Z2 direction. A thermistor (not illustrated) configured to sense a temperature of the ice making tray 5 is arranged on the lower surface 5*a* of the ice making tray 5. The thermistor is covered with a cover 36 fixed to the lower surface 5*a* of the ice making tray 5.

(Driving Unit)

As illustrated in FIG. 5, the driving unit 6 includes a casing 41 formed in a cuboid shape. The casing 41 houses a motor (not illustrated) serving as a drive source, a rotation transmission mechanism (not illustrated) configured to transmit the rotational force of the motor, and a cam gear 33 to which the rotational force of the motor is transmitted by the rotation transmission mechanism. The output shaft 10 is formed integrally with the cam gear 33. The output shaft 10 protrudes outward of the casing 41 from a hole 43 provided in an end plate 42 of the casing 41 in the X2 direction. The output shaft 10 is coupled to the coupling unit 17 provided in the first wall unit 15 of the ice making tray 5. When the ice making tray 5 is rotated from the water storage position 5A to the ice removal position 5B, the output shaft 10 rotates in the CCW direction being a counterclockwise direction around the axis L. Further, when the ice making tray 5 is returned from the ice removal position 5B to the water storage position 5A, the output shaft 10 rotates in a CW direction being a clockwise direction.

An ice detecting lever 8 is arranged at a position adjacent to the ice making tray 5 in the Y1 direction. It is noted that an ice detecting mechanism configured to operate the ice detecting lever 8 to rotate around the axis L in conjunction with the cam gear 33 according to a rotation angle of the cam gear 33, a switching mechanism configured to operate based on a signal from the thermistor, and the like, are configured in the casing 41 of the driving unit 6.

(Frame)

As illustrated in FIGS. 1 to 3, the frame 7 includes a first side plate unit 45 extending in the X direction on the side of the Y1 direction of the ice making tray 5 and the driving unit 6, and a second side plate unit 46 extending parallel to the first side plate unit 45 on the side of the Y2 direction of the ice making tray 5 and the driving unit 6. The ice detecting lever 8 is positioned between the first side plate unit 45 and the ice making tray 5. Further, the frame 7 includes an end plate unit 47 extending in the Y direction and connecting ends of the first side plate unit 45 and the second side plate unit 46 in the X1 direction, and a wall unit 48 extending in the Y direction and connecting ends of the first side plate unit 45 and the second side plate unit 46 in the X2 direction. The wall unit 48 is a porous wall in which a plurality of plate-shaped ribs are coupled to each other. A shaft hole 49 configured to rotatably support the shaft unit 18 of the ice making tray 5 is provided in the center of the wall unit 48.

Further, as illustrated in FIGS. 1 and 4, the frame 7 includes a rectangular support unit 50 protruding in the X2 direction from the upper end of the end plate unit 47 and partially connecting the first side plate unit 45 and the second side plate unit 46 above the driving unit 6. The driving unit 6 is supported by the support unit 50.

Further, the frame 7 includes a first upper plate unit 51 protruding from the upper end of the first side plate unit 45 toward the second side plate unit 46. The first upper plate unit 51 connects an end portion of the support unit 50 on the side of the Y1 direction and an end portion on the side of the Y1 direction of the upper end of the wall unit 48. In the first upper plate unit 51, an opening unit 51*a* is formed inside which an upper end unit of the ice detecting lever 8 is located. Further, the frame 7 includes a second upper plate unit 52 protruding from the upper end of the second side plate unit 46 toward the first side plate unit 45. The second upper plate unit 52 connects an end portion of the support unit 50 on the side of the Y2 direction and an end portion on the side of the Y2 direction of the upper end of the wall unit 48. Further, the frame 7 includes a water channel component 55 on the upper side (on the side of the Z1 direction) of the wall unit 48. The water channel component 55 includes an overhanging portion 55*a* protruding in the X1 direction from the wall unit 48 and extending in the Y direction, and a protruding portion 55*b* protruding in the X2 direction from the wall unit 48 substantially in the center of the overhanging portion 55*a* in the Y direction.

Here, as illustrated in FIG. 4, above the ice making tray 5, a substantially rectangular opening unit 57 is defined by the support unit 50, the first upper plate unit 51, the second upper plate unit 52, and the water channel component 55. The opening unit 57 is provided to avoid that the upper end portion of the peripheral wall unit 20 (the upper end portion of the second peripheral wall portion 22, the upper end portion of the third peripheral wall portion 23 on the side of the Y2 direction, and the upper end portion of the fourth peripheral wall portion 24 on the side of the Y2 direction) of the ice making tray 5 that moves upward interferes with the frame 7 when the ice making tray 5 flips between the water storage position 5A and the ice removal position 5B.

(Water Channel)

In the frame 7, a water channel 60 for circulating the water supplied from the water supply pipe 2, is provided on an upper surface of the water channel component 55. The water channel 60 is a concave groove that is open at the top. The water channel 60 includes a first water channel portion 61 extending in the Y direction (the direction intersecting the axis L) along the wall unit 48, and a second water channel portion 62 extending in the X2 direction along the protruding portion 55*b* substantially from the center of the first water channel portion 61 in the Y direction. The first water channel portion 61 overlaps with the overhanging portion 55*a* and the wall unit 48 when viewed from the Z direction. Therefore, the water channel 60 is provided on the upper surface of the overhanging portion 55*a*.

As illustrated in FIGS. 1 and 4, a water supply port 2*a* of the water supply pipe 2 is located in the second water channel portion 62. A bottom surface 62*a* of the second water channel portion 62 is inclined downward (in the X1 direction) toward the side of the first water channel portion 61. The water poured from the water supply port 2*a* into the second water channel portion 62 flows into the first water channel portion 61, and is poured from a water flow port 64 provided in the first water channel portion 61 to the water receiving unit 26 below the water flow port 64.

Figure 7:
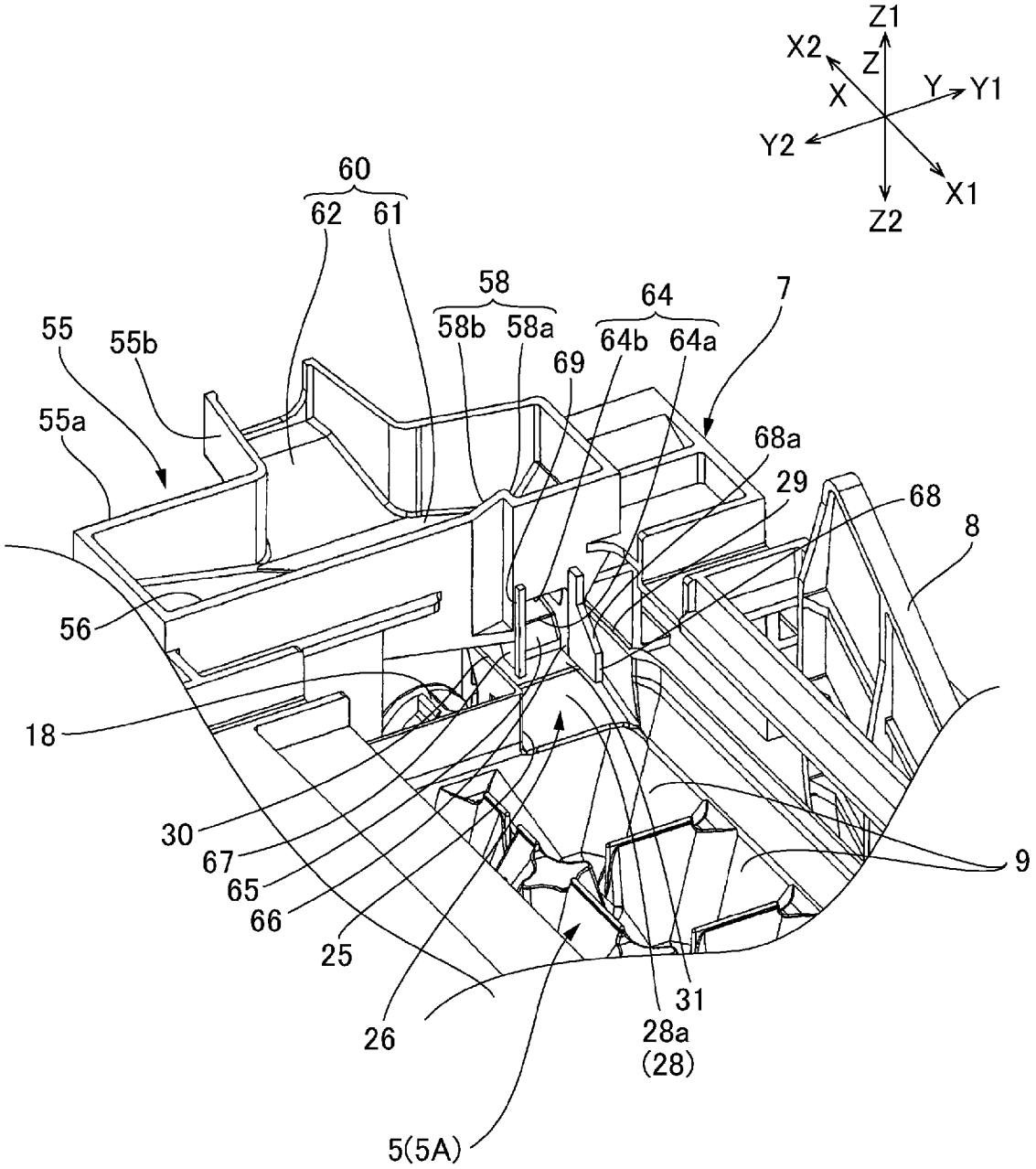
FIG. 7 is a partial enlarged view of a water channel of a frame and the periphery of a water receiving unit of the ice making tray.
Figure 8:
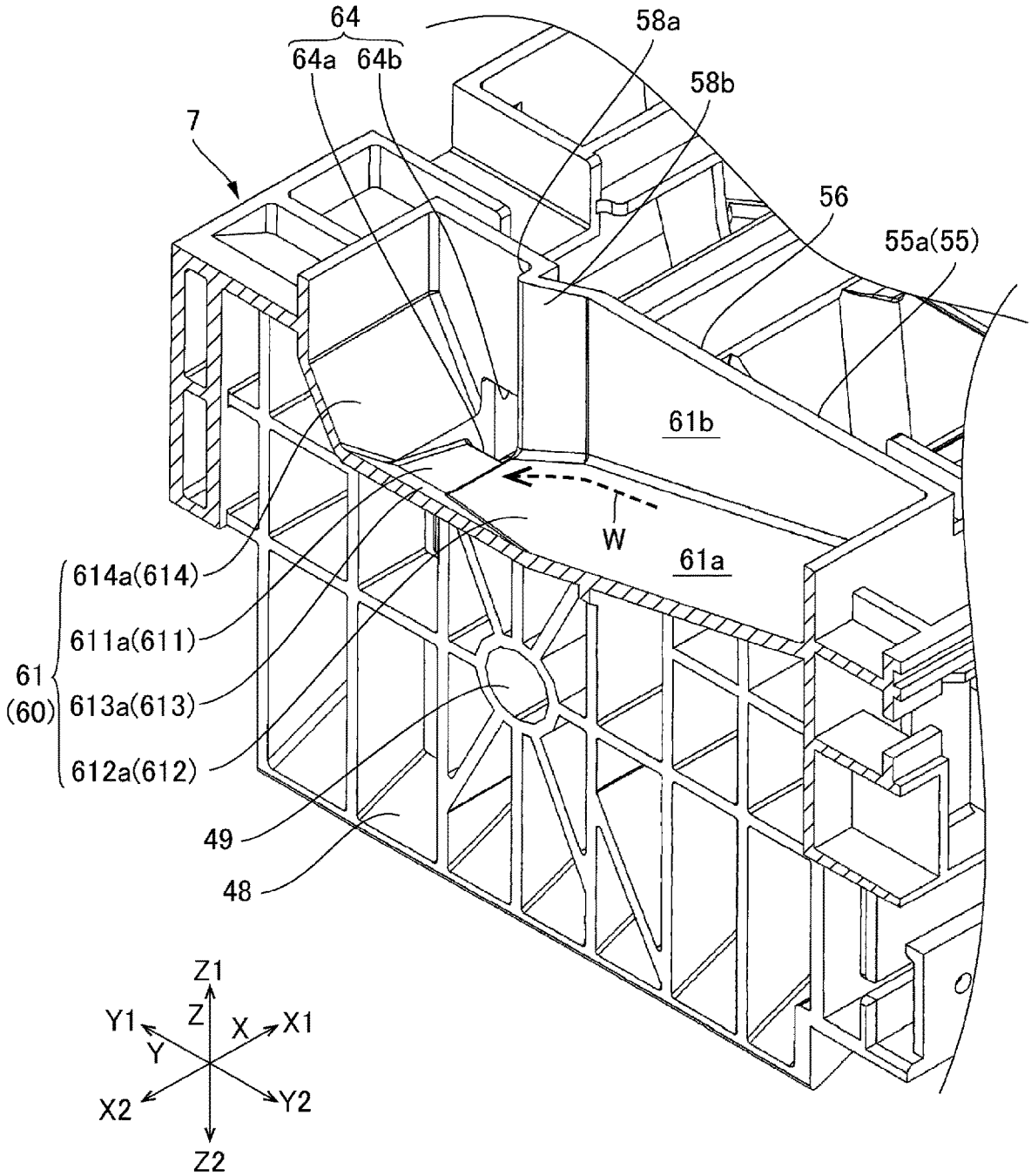
FIG. 8 is a partial cross-sectional view of the periphery of a first water channel portion of the frame.

FIG. 7 is a partial enlarged view of the water channel 60 of the frame 7 and the periphery of the water receiving unit 26 of the ice making tray 5. Further, FIG. 8 is a partial cross-sectional view of the periphery of the first water channel portion 61 of the frame 7. As illustrated in FIGS. 4 and 8, the water flow port 64 is located close to an end of the first water channel portion 61 in the Y1 direction and is located at an end of the first water channel portion 61 in the X1 direction. As illustrated in FIG. 8, a bottom surface 61*a* of the first water channel portion 61 is a rectangular concave unit 611 in which a portion of the water flow port 64 on the side of the X2 direction is recessed one step. A bottom surface 611*a* of the concave unit 611 is inclined downward toward the side of the water flow port 64 (X1 direction). The first water channel portion 61 includes the concave unit 611, a first upstream region 612 on the side of the Y2 direction with respect to the concave unit 611, a second upstream region 613 on the side of the X2 direction with respect to the concave unit 611, and a buffer region 614 on the side of the Y1 direction with respect to the concave unit 611.

A bottom surface 612*a* of the first upstream region 612 is inclined downward toward the end edge of the concave unit 611 in the Y2 direction. Further, a bottom surface 613*a* of the second upstream region 613 is inclined downward toward the end edge of the concave unit 611 in the X2 direction, and a bottom surface 614*a* of the buffer region 614 is inclined downward toward the end edge of the concave unit 611 in the Y1 direction. The water flowing from the second water channel portion 62 into the first water channel portion 61 mainly flows in the Y1 direction in the first upstream region 612, and mainly flows in the X1 direction in the second upstream region 613, to flow into the concave unit 611. Further, a part of the water flowing into the concave unit 611 and the second water channel portion 62 is diverted to the buffer region 614. The water that is diverted to the buffer region 614 returns in the Y2 direction and flows into the concave unit 611. In this way, the water in the first water channel portion 61 flows from each of the first upstream region 612, the second upstream region 613, and the buffer region 614 toward the concave unit 611 and collects in the water flow port 64.

The water channel component 55 includes a peripheral wall 56 extending along the outer peripheral edge of the overhanging portion 55*a* and the protruding portion 55*b*, and an inner side of the peripheral wall 56 is the water channel 60 that is open on the top. A side surface 61*b* of the first water channel portion 61 in the X1 direction includes a peripheral wall portion extending in the Y direction along the edge of the overhanging portion 55*a* in the X1 direction. As illustrated in FIG. 8, the water flow port 64 is provided at a corner part where the side surface 61*b* and the bottom surface 61*a* of the first water channel portion 61 are connected with each other. The water flow port 64 includes a first water flow port portion 64*a* provided at an end of the bottom surface 61*a* in the X1 direction, and a second water flow port portion 64*b* provided at the lower end of the side surface 61*b*. The water flow port 64 is an opening in which the first water flow port portion 64*a* and the second water flow port portion 64*b* are connected with each other.

(Water Blocking Unit)

As described above, in the first upstream region 612 of the first water channel portion 61, the water flowing in from the second water channel portion 62 flows toward the side where the water flow port 64 is located (Y1 direction). That is, the side where the water flow port 64 is located (Y1 direction) is the downstream side of the first upstream region 612, and the side (Y2 direction) opposite to the side where the water flow port 64 is located is the upstream side of the first upstream region 612. In the water channel component 55, a water blocking unit is provided that blocks the water flow toward the water flow port 64 along the side surface 61*b* of the first water channel portion 61 at the upstream side (in the Y2 direction) of the water flow port 64. The water blocking unit is provided at a position upstream (in the Y2 direction) with respect to the water flow port 64 and along the side surface 61*b*. The water flow along the side surface 61*b* is a water flow in a direction intersecting the opening direction (X1 direction) of the water flow port 64. Therefore, the water blocking unit is provided to reduce the flow amount of water flowing from the water flow port 64 in a direction different from the opening direction (X1 direction)

of the water flow port 64. Therefore, the water does not easily spill out of the water receiving unit 26.

In the present embodiment, a convex unit 58 that protrudes from the side surface 61*b* of the first water channel portion 61 in the X1 direction toward the inner side (X2 direction) of the first water channel portion 61 is provided as the water blocking unit. The convex unit 58 is provided at an opening edge of the second water flow port portion 64*b* in the Y2 direction. The convex unit 58 includes a first surface 58*a* facing the side (Y1 direction) where the water flow port 64 is located, and a second surface 58*b* facing the side (Y2 direction) opposite to the side where the water flow port 64 is located. Viewed from the Z direction, the planar shape of the convex unit 58 is a substantially right-angled triangle and the first surface 58*a* is connected to the opening edge of the second water flow port portion 64*b* and is substantially perpendicular to the side surface 61*b*. On the other hand, the second surface 58*b* is an inclined surface that forms an obtuse angle with the side surface 61*b*. The second surface 58*b* inclines in a direction toward the side where the water flow port 64 is located in accordance with the distance from the side surface 61*b*. As illustrated in FIG. 8, the direction of water W flowing in the Y1 direction along the side surface 61*b* is changed to a direction along the second surface 58*b*. As a result, the flow in the direction intersecting the X1 direction, which is the opening direction of the water flow port 64, does not directly reach the water flow port 64 from the first upstream region 612.

As illustrated in FIG. 7, a first guiding board 65, a second guiding board 66, and a third guiding board 67 configured to guide the water passing through the water flow port 64 are provided at the opening edge of the first water flow port portion 64*a* on the lower surface of the overhanging portion 55*a* of the water channel component 55. The first guiding board 65 is inclined downward in the X1 direction from the opening edge portion of the first water flow port portion 64*a* in the X2 direction. The second guiding board 66 extends downward from the opening edge portion of the first water flow port portion 64*a* in the Y1 direction and is connected to the end edge of the first guiding board 65 in the Y1 direction. The third guiding board 67 extends downward from the opening edge portion of the first water flow port portion 64*a* in the Y2 direction and is connected to the end edge of the first guiding board 65 in the Y2 direction.

Further, a first guide plate 68 and a second guide plate 69 configured to guide the water passing through the water flow port 64 are provided at the opening edge of the second water flow port portion 64*b* at the side surface of the overhanging portion 55*a* of the water channel component 55 in the X1 direction. The first guide plate 68 protrudes in the X1 direction from the end edge of the second water flow port portion 64*b* in the Y1 direction, extends more downward than the second water flow port portion 64*b* and is connected to the edge of the second guiding board 66 in the X1 direction. Further, the second guide plate 69 protrudes in the X1 direction from the end edge of the second water flow port portion 64*b* in the Y2 direction, extends more downward than the second water flow port portion 64*b* and is connected to the edge of the third guiding board 67 in the X1 direction. The upper ends of the first guide plate 68 and the second guide plate 69 extend more upward than the second water flow port portion 64*b*.

The first guide plate 68 that is located in the Y1 direction (that is, on the opposite side of the convex unit 58 that is the water blocking unit) with respect to the second water flow port portion 64*b* protrudes more in the X1 direction than the second guide plate 69 that is located in the Y2 direction (that is, on the same side as the convex unit 58 that is the water blocking unit) with respect to the second water flow port portion 64*b*. As illustrated in FIGS. 4 and 7, the first guide plate 68 protrudes toward the side of the X1 direction from the second wall unit 16 of the ice making tray 5, whereas the second guide plate 69 is located on the side of the X2 direction of the second wall unit 16. The upper end portion of the first guide plate 68 is provided with a notch unit 68*a* cut out to have the same protruding dimension as the second guide plate 69.

If the driving unit 6 is supported by the support unit 50 of the frame 7 and the shaft unit 18 of the ice making tray 5 is inserted into the shaft hole 49 in a state where the coupling unit 17 of the ice making tray 5 is coupled to the output shaft 10 of the driving unit 6, the driving unit 6 and the ice making tray 5 are supported by the frame 7, as illustrated in FIGS. 1 to 4. If the driving unit 6 and the ice making tray 5 are supported by the frame 7, the ice making tray 5 can be rotated around the axis L when the driving unit 6 is operated.

Further, if the driving unit 6 and the ice making tray 5 are supported by the frame 7 and the ice making tray 5 is arranged in the water storage position 5A, the overhanging portion 55*a* (frame portion) of the water channel component 55 is located in the Z1 direction of the water receiving unit 26 of the ice making tray 5, as illustrated in FIG. 7. Further, the water receiving unit 26 (the upper surface 28*a* of the bottom unit 28) of the ice making tray 5 and the water flow port 64 provided in the overhanging portion 55*a* overlap, when viewed from the Z direction. Further, the lower ends of the first guiding board 65, the second guiding board 66, the third guiding board 67, the first guide plate 68, and the second guide plate 69 provided in the overhanging portion 55*a* of the frame 7 are located lower than the upper ends of the side plate units 29 and 30 and the end plate unit 31 of the water receiving unit 26.

Here, as illustrated in FIG. 2, in the wall unit 48, there is provided an abutment unit 70 configured to abut against the water receiving unit 26 from the front in the CCW direction, when the ice making tray 5 rotates around the axis L from the water storage position 5A in the CCW direction to reach the ice removal position 5B. The abutment unit 70 protrudes in the X1 direction from the wall unit 48. The bottom unit 28 of the water receiving unit 26 abuts against the abutment unit 70. In the ice removal position 5B, the abutment unit 70 abuts against the water receiving unit 26 and blocks the rotation of the ice making tray 5 that is driven in the CCW direction. As a result, the ice making tray 5 is twisted.

(Ice Making Operation)

Figure 9A:
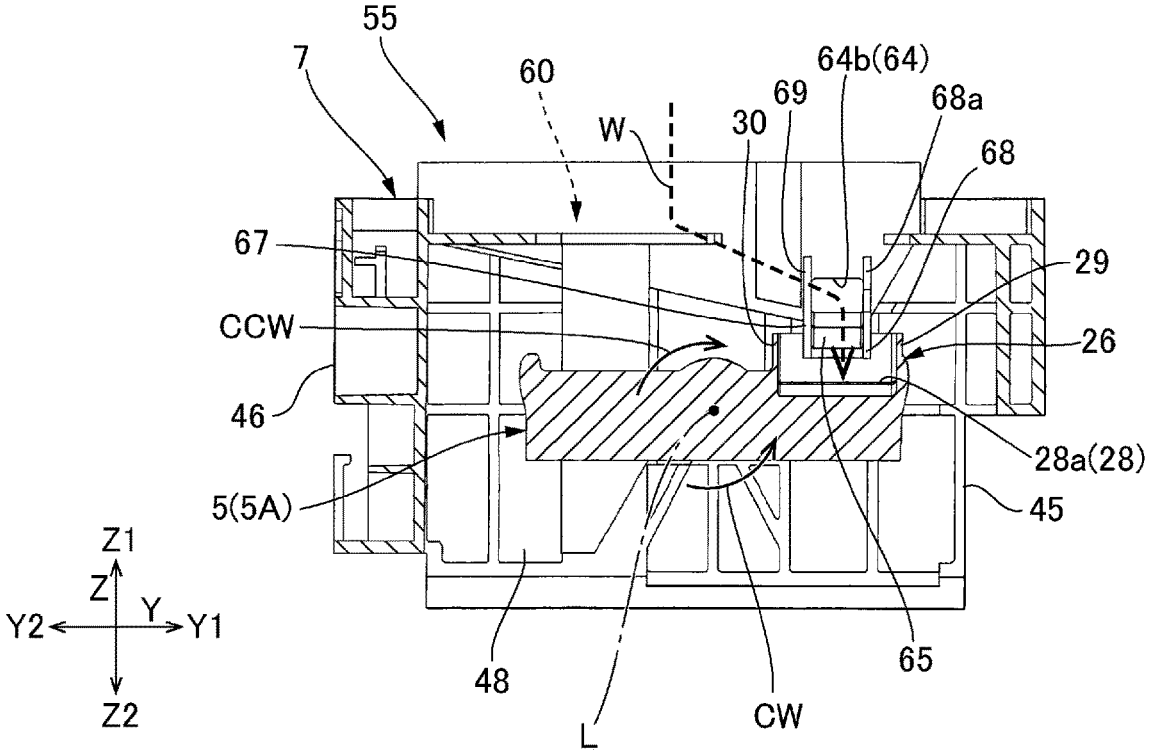
FIGS. 9A and 9B are cross-sectional views of the ice maker with the ice making tray in the water storage position.
Figure 9B:
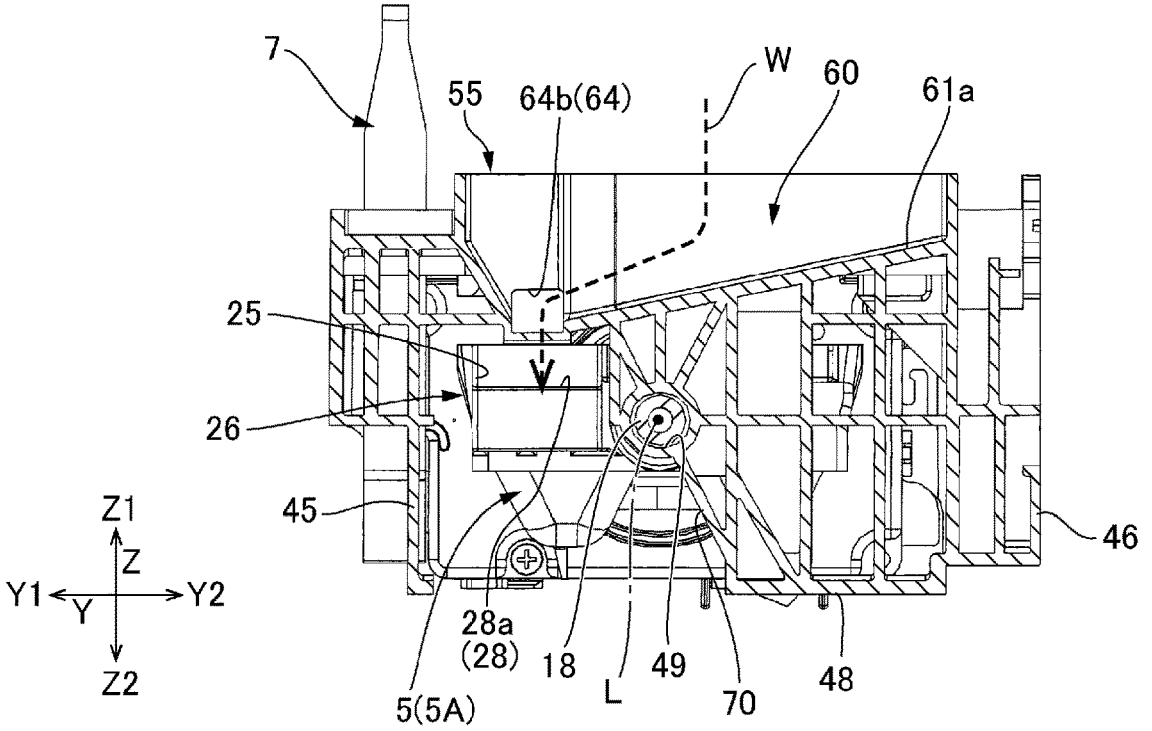
Figure 10A:
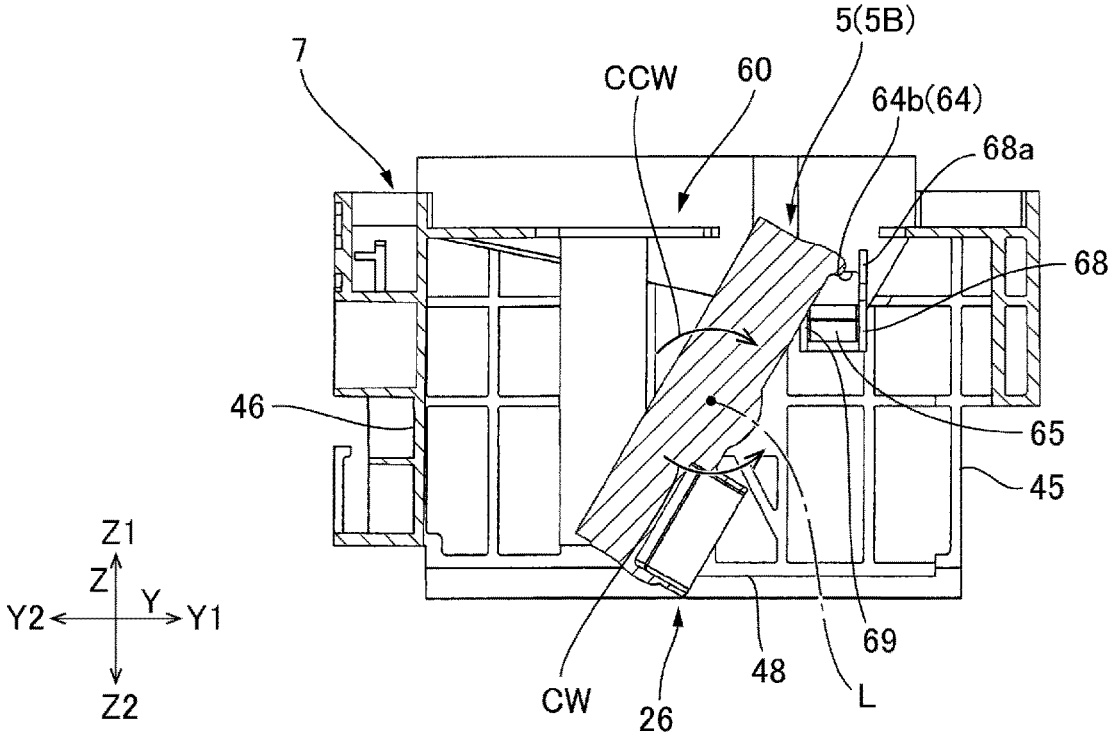
FIGS. 10A and 10B are cross-sectional views of the ice maker with the ice making tray in the ice removal position.
Figure 10B:
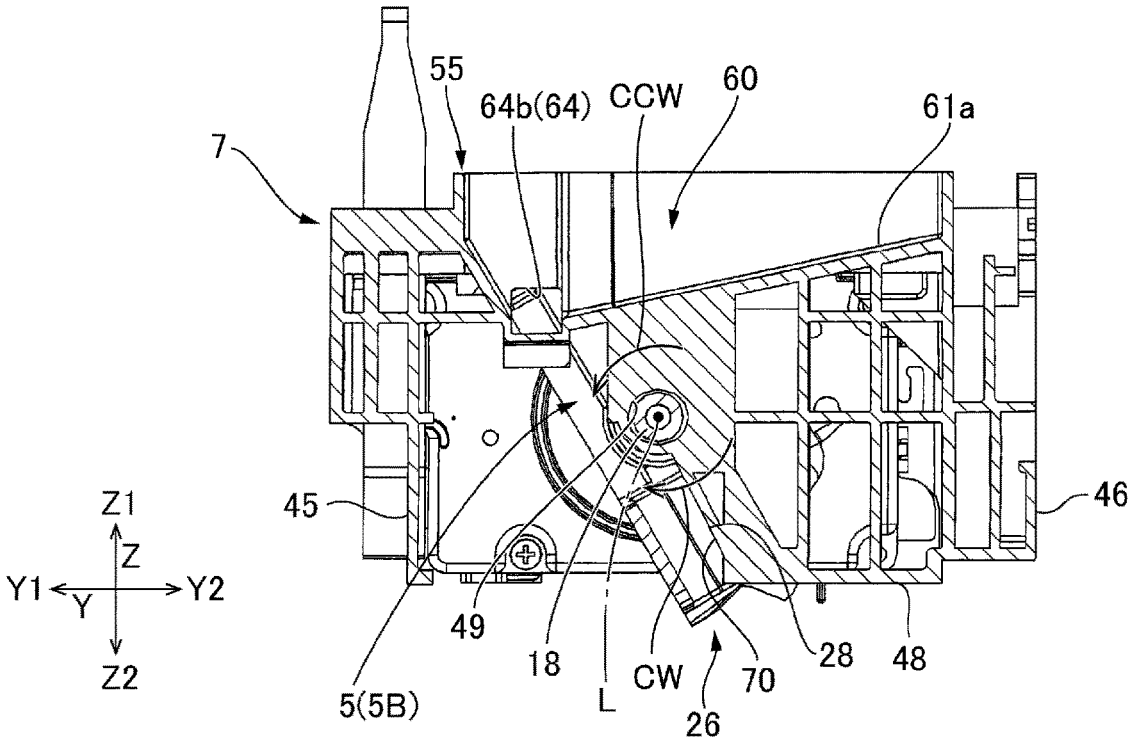

FIGS. 9A and 9B are cross-sectional views of the ice maker 1 in a state where the ice making tray 5 is arranged in the water storage position 5A. In FIG. 9A, the ice maker 1 is cut along a plane perpendicular to the axis L and passing through the water receiving unit 26 of the ice making tray 5 and in FIG. 9B, the ice maker 1 is cut along a plane perpendicular to the axis L and passing through the abutment unit 70 of the wall unit 48 of the frame 7. FIGS. 10A and 10B are cross-sectional views of the ice maker 1 in a state where the ice making tray 5 is arranged in the ice removal position 5B. In FIG. 10A, the ice maker 1 is cut along a plane perpendicular to the axis L and passing through the water receiving unit 26 of the ice making tray 5, and in FIG. 10B, the ice maker 1 is cut along a plane perpendicular to the axis L and passing through the abutment unit 70 of the wall unit 48 of the frame 7.

In an initial state at the start of the ice making operation, the ice making tray 5 is arranged in the water storage position 5A, as illustrated in FIG. 1. In this state, a predetermined amount of water is supplied from the water supply pipe 2. As illustrated by dashed arrows in FIGS. 9A and 9B, the water W supplied from the water supply pipe 2 via the water supply port 2*a* flows from the second water channel portion 62 to the first water channel portion 61 of the water channel 60 toward the water flow port 64. Further, the water passes through the water flow port 64 and is poured into the water receiving unit 26 of the ice making tray 5 located below the water flow port 64. At this time, when the water passing through the water flow port 64 is poured into the water receiving unit 26, the water is guided by the first guiding board 65, the second guiding board 66, the third guiding board 67, the first guide plate 68, and the second guide plate 69 toward the notch unit 25.

Next, the water poured from the water flow port 64 into the water receiving unit 26 flows via the notch unit 25 of the peripheral wall unit 20 of the ice making tray 5 into the water storage concave units 9 and is stored in the water storage concave units 9. Here, the bottom unit 28 facing the water flow port 64 in the water receiving unit 26 includes the upper surface 28*a* that is inclined downward (in the Z2 direction) toward the notch unit 25. Therefore, the water poured from the water flow port 64 into the water receiving unit 26 flows without stagnation and is stored in the water storage concave units 9. Further, the ice making tray 5 includes the peripheral wall unit 20 that extends upward and surrounds the openings of the water storage concave units 9, and thus, the water flowing from the water receiving unit 26 via the notch unit 25 into the water storage concave units 9 is prevented from scattering from the ice making tray 5 to the outside.

When the filling of the water into the water storage concave units 9 is completed, the water supply is stopped. Afterwards, the water filled into the ice making tray 5 is cooled. Whether or not the ice making is completed is determined by a thermistor attached to the ice making tray 5 depending on whether the temperature of the ice making tray 5 is equal to or lower than a predetermined temperature.

If the ice making is completed, the ice detecting lever 8 detects the amount of ice in the ice storage container installed below the ice making tray 5. Specifically, the ice detecting lever 8 is driven by the driving unit 6 to descend. At this time, if the ice detecting lever 8 descends to a predetermined position, it is determined that the inside of the ice storage container is not full of ice. On the other hand, if the ice detecting lever 8 comes in contact with the ice in the ice storage container before descending to the predetermined position, it is determined that the ice storage container is full of ice. If the ice storage container is full of ice, after waiting for a predetermined time, the ice detecting lever 8 detects again the amount of ice in the ice storage container.

If the inside of the ice storage container is not full of ice, the ice is removed from the ice making tray 5 and dropped into the ice storage container. Specifically, the output shaft 10 is rotated in the CCW direction by the drive of the driving unit 6, and the ice making tray 5 is rotated in the CCW direction around the axis L.

Here, the water receiving unit 26 provided to protrude outward from the ice making tray 5 moves downward when the ice making tray 5 starts to rotate in the CCW direction from the water storage position 5A toward the ice removal position 5B. That is, when the ice making tray 5 rotates in the CCW direction, the water receiving unit 26 moves away from the overhanging portion 55*a* of the water channel component 55 located above the water receiving unit 26. Therefore, even if the water receiving unit 26 arranged in the ice making tray 5 is provided, the water receiving unit 26 does not interfere with a portion of the frame 7.

The ice making tray 5 rotates by a predetermined rotation angle of 90° or more (for example, 120°) from the water storage position 5A where the ice making tray 5 is arranged horizontally, and reaches the ice removal position 5B. As illustrated in FIG. 10A, in the ice removal position 5B, the peripheral wall unit 20 of the ice making tray 5 is located further in the Y1 direction relative to the second guide plate 69 arranged on the opening edge of the water flow port 64. However, the second guide plate 69 does not protrude far in the X1 direction, and thus, the second guide plate 69 and the ice making tray 5 do not interfere with each other. Further, although the first guide plate 68 protrudes more in the X1 direction than the second guide plate 69, the notch unit 68*a* is arranged on the upper end of the first guide plate 68. Therefore, the ice making tray 5 can be rotated to the ice removal position 5B without interference between the first guide plate 68 and the ice making tray 5.

As illustrated in FIG. 10B, in the ice removal position 5B, the abutment unit 70 of the frame 7 abuts against the bottom unit 28 of the water receiving unit 26 of the ice making tray 5. Here, at the time when the water receiving unit 26 of the ice making tray 5 abuts against the abutment unit 70, the ice making tray 5 is driven in the CCW direction by the driving unit 6, however, due to the contact between the water receiving unit 26 and the abutment unit 70, the ice making tray 5 is prevented from further rotating in the CCW direction. As a result, the ice making tray 5 is twisted and deformed. Therefore, the ice in the ice making tray 5 is separated from the water storage concave units 9, removed from the ice making tray 5, and drops into the ice storage container.

After that, the driving unit 6 rotates the ice making tray 5 in the CW direction to return the ice making tray 5 to the water storage position 5A where the water storage concave units 9 face upward. Afterwards, the above-described ice making operation is repeated.

(Main Operation and Effect of Present Embodiment)

In the ice maker 1 according to the present embodiment, the water from the water supply pipe 2 passes through the water flow port 64 arranged in the frame 7, is poured into the water receiving unit 26 protruding outward from the ice making tray 5, and flows from the water receiving unit 26 into the water storage concave units 9. Therefore, the water supply port 2*a* of the water supply pipe 2 can be positioned outside the ice making tray 5. As a result, it is not necessary to arrange the water supply port 2*a* of the water supply pipe 2 above the ice making tray 5 at a position separated from the rotation area of the ice making tray 5, and thus, the installation space of the ice maker 1 including the water supply pipe 2 can be reduced in the up-down direction.

Further, if the water supply port 2*a* of the water supply pipe 2 is arranged above the ice making tray 5, it is necessary that the position of the water supply port 2*a* is above the rotation area when the ice making tray 5 is flipped, and thus, the distance between the water supply port 2*a* and the water storage concave units 9 easily separate. Therefore, when the water from the water supply port 2*a* of the water supply pipe 2 is poured into the water storage concave units 9, the water is easily scattered, and thus, it is necessary to increase the height of the peripheral wall unit 20 that extends upward and surrounds the openings of the plurality of water storage concave units 9 in the ice making tray 5. On the other hand, as described in the present embodiment, if the water from the water supply pipe 2 passes through the water flow port 64 arranged in the frame 7, is poured into the water receiving unit 26 protruding outward from the ice making tray 5, and flows into the water storage concave units 9, scattering of the water occurring when the water is poured into the water storage concave units 9 can be prevented or suppressed. Therefore, the height of the peripheral wall unit 20 can be reduced. As a result, if the ice making tray 5 is in the water storage position 5A, the ice making tray 5 can be made smaller in the up-down direction Z.

In the present embodiment, the frame 7 is provided with the first water channel portion 61 intersecting the direction of the axis L. A part of the water flow port 64 (the second water flow port portion 64*b*) is provided on the side surface 61*b* on the side of the ice making tray 5 (X1 direction) of the first water channel portion 61. Further, the frame 7 includes the convex unit 58 that functions as the water blocking unit and is arranged in a position on the upstream side (Y2 direction) of the water flow port 64 and along the side surface 61*b* in which the water flow port 64 is provided. Therefore, on the upstream side of the water flow port 64, the flow in a direction (direction along the side surface 61*b*) intersecting the opening direction (X1 direction) of the water flow port 64 can be blocked by the convex unit 58, and it is possible to prevent or suppress water flowing in a direction different from the opening direction of the water flow port 64, from reaching the water flow port 64. As a result, it is possible to reduce the flow amount of water flowing from the water flow port 64 in a direction different from the opening direction (X1 direction) of the water flow port 64, and thus, the water is not likely to spill out of the water receiving unit 26 provided below the water flow port 64.

In the present embodiment, the convex unit 58 that protrudes from the side surface 61*b* toward the inside of the first water channel portion 61 is provided as the water blocking unit. As a result, the water blocking unit can be integrally formed with the side surface 61*b*, so that a simple structure can be chosen for the water blocking unit. Further, the water blocking unit is formed integrally with the side surface 61*b* to effectively block the flow toward the water flow port 64 along the side surface 61*b*.

In the present embodiment, the convex unit 58 is provided at the opening edge of the water flow port 64, and thus, the flow in a direction (direction along the side surface 61*b*) intersecting the opening direction of the water flow port 64 can be blocked immediately before the water flow port 64. Therefore, the flow in the direction different from the opening direction of the water flow port 64 can be effectively reduced.

The convex unit 58 according to the present embodiment includes the first surface 58*a* facing the side where the water flow port 64 is located, and the second surface 58*b* facing the side opposite to the side where the water flow port 64 is located and the first surface 58*a* is connected to the opening edge of the water flow port 64 and is substantially perpendicular to the side surface 61*b* of the first water channel portion 61. Further, the second surface 58*b* is an inclined surface that forms an obtuse angle with the side surface 61*b*. When the second surface 58*b* is an inclined surface, the water can be prevented from splashing due to the flow from the upstream side colliding with the second surface 58*b*, and the water can be prevented or suppressed from spilling from the water channel 60. Further, it is possible to prevent or suppress water from remaining between the side surface 61*b* and the second surface 58*b* and freezing. Moreover, the water can be guided by the first surface 58*a* to flow in the opening direction of the water flow port 64 immediately before the water flow port 64. Therefore, the flow amount of water flowing from the water flow port 64 in a direction different from the opening direction of the water flow port 64 can be reduced.

In the present embodiment, in the water channel 60 of the frame 7, there is provided the buffer region 614 extending to the opposite side (side of the Y1 direction) of the convex unit 58 with respect to the water flow port 64, and thus, it is possible to suppress the occurrence of water splash on the opposite side of the convex unit 58 with respect to the water flow port 64. Therefore, it is possible to prevent or suppress water from spilling from the water channel 60.

In the present embodiment, the bottom surface 62*a* of the second water channel portion 62 is inclined downward toward the side of the first water channel portion 61. Further, the bottom surface 61*a* of the first water channel portion 61 is inclined downward toward the water flow port 64. That is, each of the bottom surface 612*a* of the first upstream region 612, the bottom surface 613*a* of the second upstream region 613, and the bottom surface 614*a* of the buffer region 614 are inclined surfaces that are inclined downward toward the concave unit 611, and the bottom surface 611*a* of the concave unit 611 is inclined downward toward the side of the water flow port 64 (X1 direction). Therefore, the water supplied from the water supply pipe 2 flows to the water flow port 64 without stagnation. Further, when the water supply is stopped, the water in the water channel 60 can be collected toward the water flow port 64. Therefore, it is possible to prevent or suppress water from remaining in the water channel 60 and freezing.

In the present embodiment, in the overhanging portion 55*a* of the water channel component 55, there are provided the first guide plate 68 and the second guide plate 69 protruding outward (toward the X1 direction) along the opening edge of the second water flow port portion 64*b*. Therefore, the water flowing from the water flow port 64 can be guided on the outer side of the water channel 60, and thus, the water does not easily spill out of the water receiving unit 26. Further, the first guide plate 68 is located on the opposite side of the convex unit 58 (water blocking unit) with respect to the water flow port 64 and is provided on a side where the water easily flows from the water flow port 64 in a direction different from the opening direction of the water flow port 64. In addition, a protruding dimension of the first guide plate 68 that is provided on the side where the water easily flows is larger than a protruding dimension of the second guide plate 69. As a result, the effect of preventing water from spilling out of the water receiving unit 26 is enhanced. Further, the notch unit 68*a* is provided on the upper end portion of the first guide plate 68, and thus, interference between the ice making tray 5 and the first guide plate 68 can be avoided.

Further, in the present embodiment, in the overhanging portion 55*a* of the water channel component 55, there are provided the first guiding board 65, the second guiding board 66, and the third guiding board 67 protruding in the Z2 direction (downward) from the opening edge of the water flow port 64. Therefore, when the water passing through the water flow port 64 is poured into the water receiving unit 26, the water is guided by the first guiding board 65 toward the notch unit 25. Further, the water passing through the water flow port 64 is guided by the second guiding board 66 and the first guide plate 68, as well as the third guiding board 67 and the second guide plate 69, and thus, water is prevented or suppressed from scattering in the Y direction after passing the water flow port 64. Further, as illustrated in FIG. 7, the water receiving unit 26 of the ice making tray 5 and the water flow port 64 provided in the overhanging portion 55*a* overlap when viewed from the Z direction, and the lower ends of the first guiding board 65, the second guiding board 66, the third guiding board 67, the first guide plate 68, and the second guide plate 69 provided in the overhanging portion 55*a* of the frame 7 are located lower than the upper ends of the side plate units 29 and 30 and the end plate unit 31 of the water receiving unit 26. Therefore, the water can be surely poured into the water receiving unit 26 after passing the water flow port 64.

In the present embodiment, the water receiving unit 26 protrudes from the ice making tray 5 in the direction along the axis L. Therefore, compared with a case where the water receiving unit 26 protrudes from the ice making tray 5 in the direction orthogonal to the axis L, the rotation area when the ice making tray 5 is flipped can be made smaller. Therefore, it is possible to prevent the size of the ice maker 1 from increasing in the direction orthogonal to the axis L.

In the present embodiment, the driving unit 6 is coupled to one side of the ice making tray 5 in the direction of the axis L, and the water receiving unit 26 protrudes outward from a portion on the other side of the ice making tray 5 in the direction of the axis L. Therefore, even if the water poured into the water receiving unit 26 is scattered, it is possible to prevent or suppress the water from reaching the driving unit 6.

In the present embodiment, the ice making tray 5 is made of a flexible material, and the frame 7 includes the abutment unit 70 that abuts against the water receiving unit 26 from the front in the CCW direction in which the ice making tray 5 moves from the water storage position 5A to the ice removal position 5B. As a result, the ice making tray 5 can be twisted by utilizing the water receiving unit 26, and thus, the ice is easily removed from the ice making tray 5 when the ice making tray 5 reaches the ice removal position 5B.

(Modifications)

(1) In the embodiment described above, the convex unit 58 that functions as the water blocking unit is formed integrally with the side surface 61*b*, however, the water blocking unit may not be formed integrally with the side surface 61*b* and may be provided at a position along the side surface 61*b*. For example, another member may be attached to the frame 7 and the other member or the convex unit 58 may be shaped to protrude upward from the bottom surface 61*a*.

(2) In the embodiment described above, the water supply pipe 2 is arranged so that the water supply port 2*a* of the water supply pipe 2 is located above the second water channel portion 62 of the water channel 60, however, the water supply pipe 2 may be arranged so that the water supply port 2*a* of the water supply pipe 2 is located above the first water channel portion 61. In this case, the second water channel portion 62 can be omitted. Further, the degree of freedom in the installation of the water supply pipe 2 is increased.

(3) The water receiving unit 26 can also be provided to protrude from the first peripheral wall portion 21 of the peripheral wall unit 20 of the ice making tray 5 in a direction orthogonal to the axis L. In this case, the notch unit 25 is provided on the first peripheral wall portion 21 of the peripheral wall unit 20 and the water receiving unit 26 and the water storage concave units 9 are in communication via the notch unit 25. Further, when the ice making tray 5 is arranged in the water storage position 5A, the water flow port 64 is provided in the first upper plate unit 51 at a position overlapping with the water receiving unit 26 when viewed from the Z direction, and the water channel 60 extends in the X direction along the first upper plate unit 51 until a position where the water flow port 64 is provided

What is claimed is:

1. An ice maker comprising:

an ice making tray, including a water storage concave unit configured to store water supplied from a water supply pipe;

a driving unit, comprising a motor and configured to make the ice making tray rotate around an axis passing through the ice making tray, so as to flip between a water storage position where the water storage concave unit faces upward and an ice removal position where the water storage concave unit faces downward; and a frame, configured to support the ice making tray and the driving unit, wherein the frame supports the driving unit coupled to one side of the ice making tray in a direction of the axis, and the frame comprises a wall unit which rotatably supports the ice making tray on an other side of the ice making tray in the direction of the axis, the ice making tray comprises:

a peripheral wall unit which is extended upward so as to surround an opening of the water storage concave unit; and a water receiving unit which comprises a surface and is integrally formed with the peripheral wall unit so that the water receiving unit is protruded to the other side in the direction of the axis from a portion of the ice making tray that moves downward when the ice making tray starts to rotate in a first rotation direction from the water storage position toward the ice removal position, and the water receiving unit is in communication with the water storage concave unit through a notch unit provided in a part of the peripheral wall unit, the wall unit which rotatably supports the ice making tray comprises a frame portion located above the water receiving unit, the frame portion comprises a water channel component having a concave groove that is opened on an upper side on the wall unit, the water channel component comprises:

a water channel extending in a direction intersecting the axis, a water flow port, wherein at least a part of the water flow port is provided on a side surface of the water channel component, and a water blocking unit, comprising a surface and provided at a position on an upstream side of the water channel with respect to the water flow port and along the side surface to block the water flowing to the water flow port, the water flow port is disposed at a position overlapping with the water receiving unit to cause the water to flow when the ice making tray in the water storage position is viewed from an up-down direction, and wherein the ice maker is configured such that the water poured into the water channel component and flowed through the water channel in the direction intersecting the axis is blocked by the water blocking unit and is poured into the water receiving unit through the water flow port, and flows into the water storage concave unit.

2. The ice maker according to claim 1, wherein the water blocking unit is a convex unit protruding from the side surface toward an inner side of the water channel component.

3. The ice maker according to claim 2, wherein the convex unit is provided at an opening edge of the water flow port.

4. The ice maker according to claim 3, wherein the convex unit comprises:

a first surface facing a side where the water flow port is located; and a second surface facing a side opposite to the side where the water flow port is located, wherein the first surface is connected to the opening edge of the water flow port and is substantially perpendicular to the side surface, and the second surface is an inclined surface forming an obtuse angle with the side surface.

5. The ice maker according to claim 1, wherein the water channel comprises a buffer region extending to an opposite side of the water blocking unit with respect to the water flow port.

6. The ice maker according to claim 1, wherein a first surface of a second water channel portion of the water channel component is inclined downward toward the side of a first water channel portion of the water channel component, and the first surface comprises an inclined surface descending toward the water flow port.

7. The ice maker according to claim 1, wherein the frame portion comprises a guide plate protruding from an opening edge of the water flow port to outside of the water channel component.

8. The ice maker according to claim 7, wherein the guide plate is located on an opposite side of the water blocking unit with respect to the water flow port.

9. The ice maker according to claim 8, wherein the guide plate comprises:

a first guide plate, located on the opposite side of the water blocking unit with respect to the water flow port; and a second guide plate, located on a same side as the water blocking unit with respect to the water flow port, wherein a protruding dimension of the first guide plate protruding from the opening edge is larger than a protruding dimension of the second guide plate protruding from the opening edge.

10. The ice maker according to claim 7, wherein the water flow port comprises:

a first water flow port portion, provided on a first surface of a second water channel portion of the water channel component, wherein the first surface of the second water channel portion of the water channel component is inclined downward toward the side of a first water channel portion of the water channel component; and a second water flow port portion, provided on the side surface and connected to the first water flow port portion, wherein the guide plate extends in an up-down direction along an opening edge of the second water flow port portion and is connected to a guiding board protruding downward from an opening edge of the first water flow port portion, the guiding board configured to guide water passing through the water flow port into the water receiving unit.

11. The ice maker according to claim 10, wherein the water receiving unit, comprises:

a first unit, comprising a surface, protruding outward from an edge portion on a lower side of the notch unit in the peripheral wall unit and facing the frame portion when the ice making tray is arranged in the water storage position;

a pair of side plate units with lower ends connected to the first unit, wherein the pair of side plate units protrude outward respectively from an edge portion on one side and an edge portion on an other side of the notch unit of the peripheral wall unit; and an end plate unit, connecting a tip end portion of the first unit and tip end portions of the pair of side plate units, wherein a lower end of the guiding board is located lower than an upper end of the pair of side plate units when the ice making tray is arranged in the water storage position.

12. The ice maker according to claim 1, wherein the ice making tray is made of a flexible material, and the frame comprises an abutment unit, abutting the water receiving unit from a front side in the first rotation direction when the ice making tray rotates in the first rotation direction and reaches the ice removal position, so as to block a rotation of the ice making tray that is driven in the first rotation direction.

* * * * *